US006500320B2

(12) United States Patent
Glöckner

(10) Patent No.: US 6,500,320 B2
(45) Date of Patent: Dec. 31, 2002

(54) FASTENING APPARATUS

(76) Inventor: Ferdinand Glöckner, Auf der Heibroike 18, D-33719 Bielefeld (DE)

( * ) Notice: Subject to any disclaimer, the term of this patent is extended or adjusted under 35 U.S.C. 154(b) by 61 days.

(21) Appl. No.: 09/756,081

(22) Filed: Jan. 8, 2001

(65) Prior Publication Data

US 2001/0054550 A1 Dec. 27, 2001

(30) Foreign Application Priority Data

Jun. 27, 2000 (DE) ..... 100 30 339

(51) Int. Cl.[7] ..... C25B 9/09

(52) U.S. Cl. ..... 204/297.09; 204/297.1; 204/297.14

(58) Field of Search ..... 204/297.03, 297.1, 204/297.14, 279, 281

(56) References Cited

U.S. PATENT DOCUMENTS 6,267,856 B1 * 7/2001 Brown ..... 204/297.06

* cited by examiner

*Primary Examiner*—Bruce F. Bell
(74) *Attorney, Agent, or Firm*—Laurence A. Greenberg; Werner H. Stemer; Ralph E. Locher

(57) ABSTRACT

A fastening apparatus is provided, in particular, for work-pieces in the form of plates for use in electrochemical baths. The fastening apparatus ensures that the contact quality is achieved irrespective of the thickness of the work-piece. The fastening apparatus has limbs that are connected to one another via a multi-jointed connection, and that contact surfaces of contacts are aligned parallel to one another in every opening position of the limbs.

10 Claims, 2 Drawing Sheets

FASTENING APPARATUS

BACKGROUND OF THE INVENTION

Field of the Invention

The invention relates to a fastening apparatus, in particular for work-pieces in the form of plates used in electrochemical baths. The fastening apparatus has limbs that are connected to one another via a joint and a spring that compresses the limb ends of the limbs. In a region of the limb ends, electrical contacts are provided which are aligned inwards and have mutually parallel contact surfaces between which the work-piece can be clamped.

Known fastening apparatuses are configured essentially as simple brackets composed of two limbs which are connected to one another via a joint, with a compression spring being inserted on the side opposite the joint. The spring compresses the limb ends opposite the joint, and with these limb ends having contacts via which currents of up to 200 A per bracket are introduced into the work-piece suspended in an electrochemical bath, through a bus bar which is connected to the limbs.

One particular disadvantage of the known brackets is that the contacts do not always lie parallel on the surface of the work-piece, depending on the thickness of the work-piece, thus impairing the current flow, and hence the desired coating result.

SUMMARY OF THE INVENTION

It is accordingly an object of the invention to provide a fastening apparatus that overcomes the above-mentioned disadvantages of the prior art devices of this general type, which ensures that the contact quality is not related to the thickness of the work-piece.

With the foregoing and other objects in view there is provided, in accordance with the invention, a fastening apparatus. The fastening apparatus includes limbs having limb ends, a multi-jointed connection connecting the limbs to one another, and a spring for compressing the limb ends of the limbs and the spring is disposed on at least one of the limbs. Electrical contacts are disposed in a region of the limb ends and are aligned inwards with respect to one another and have mutually parallel contact surfaces between which a work-piece can be clamped. The electrical contacts have contact surfaces aligned parallel to one another in every opening position of the limbs.

The fastening apparatus has limbs that are connected to one another via a multi-jointed connection that ensures that the contact surfaces remain aligned parallel to one another in every opening position of the limbs. This allows work-pieces in the form of plates and of different thickness to be fixed in an electrochemical bath, with the entire contact surfaces of all the contacts always being conductively connected to the surface of the work-piece. A current that is produced for the electrochemical process can thus be introduced optimally and over a large area into the work-piece without any resistances to reduce the power.

It is also advantageous that the fact that the contact surfaces rest in a plane-parallel manner on the work-piece also results in the contact pressure being transmitted over a large area to the work-piece, without any edges or corners of the contacts making indentations in the work-pieces.

According to one particularly preferred embodiment of the invention, the two limbs are connected to one another via a four-jointed connection which allows the limbs to open, when they are disposed parallel to one another in a closed original position, such that they remain parallel to one another in every opening state. This allows all work-pieces that are in the form of plates and have different thicknesses to be mounted between the contact surfaces such that they are likewise aligned parallel to the surface.

The opening movement is in this case produced via an operating lever which rotates against a spring force about a joint of the base limb and which acts via a second joint on the clamping limb, necessarily resulting in the required movement by a coupling element which is disposed parallel and is likewise connected via two joints to the base limb and to the clamping limb, with the distance between the joints being the same.

In accordance with an added feature of the invention, the multi-jointed connection is a four-jointed connection having two coupling elements and two struts that are each disposed on one of the limbs and are each connected in a jointed manner to one another by the two coupling elements. An operating lever is provided and is disposed on one of the two coupling elements.

In contrast to the above-mentioned four-jointed connection, a further preferred embodiment is equipped with a six-jointed connection which has two coupling elements which are each disposed on a strut of a limb via joints thereon and are in turn connected at their front end via joints to a strut of the clamping limb. The rear ends of the limbs have lengthening projections which are connected to one another via a coupling piece, with these coupling pieces being connected to one another via joints. An operating lever is disposed on the coupling piece, which operating lever is aligned approximately parallel to the fastening end of the base limb so that the parallel opening movement of the limbs can take place by a linear feed movement, in particular by an apparatus operated by a machine.

This last-mentioned embodiment is furthermore particularly advantageous in that the spring can be disposed at a long distance from the rotating joints so that the advantageous lever lengths result in a very large clamping force between the contact surfaces. At its fastening end, the base limb preferably has orifices, via which it can be fastened to a bus bar. The clamping limb, on the other hand, is provided with a connecting lug, by which it can be likewise short-circuited to a bus bar via a connecting line, in which case this configuration assures that the current flow is not impeded by the joints that are involved, since they are completely bypassed.

Advantageous embodiments of the fastening apparatus according to the invention can be equipped with limbs which are configured in the form of forks in a region of the contacts, in which case the ends, which are then in the form of tines, each have separate contacts.

The contacts need not necessarily be directly opposite one another, but can also be disposed offset with respect to one another, in which case, for example, two contacts at one limb end can be fixed such that they are spaced slightly apart from one another and an individual opposite contact can be disposed roughly opposite the space in-between the adjacent contacts.

In accordance with an additional feature of the invention, the operating lever and one of the limbs, being a base limb, are configured to be parallel to one another.

In accordance with another feature of the invention, the spring is disposed between the base limb and the operating lever.

In accordance with a further feature of the invention, the limbs include a clamping limb and a base limb and the multi-jointed connection includes a joint. A contact lug for connecting to an electrical connecting line is disposed in front of the joint on the clamping limb at an end opposite the contacts.

In accordance with a further added feature of the invention, more than one of the electrical contacts is disposed at one of the limb ends, and in that the electrical contacts are disposed offset with respect to one another.

In accordance with a further additional feature of the invention, the limbs are configured for receiving work-pieces in a form of plates for use in electrochemical baths.

In accordance with a concomitant feature of the invention, the spring is disposed between one of the limbs and one of the coupling elements.

Other features which are considered as characteristic for the invention are set forth in the appended claims.

Although the invention is illustrated and described herein as embodied in a fastening apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
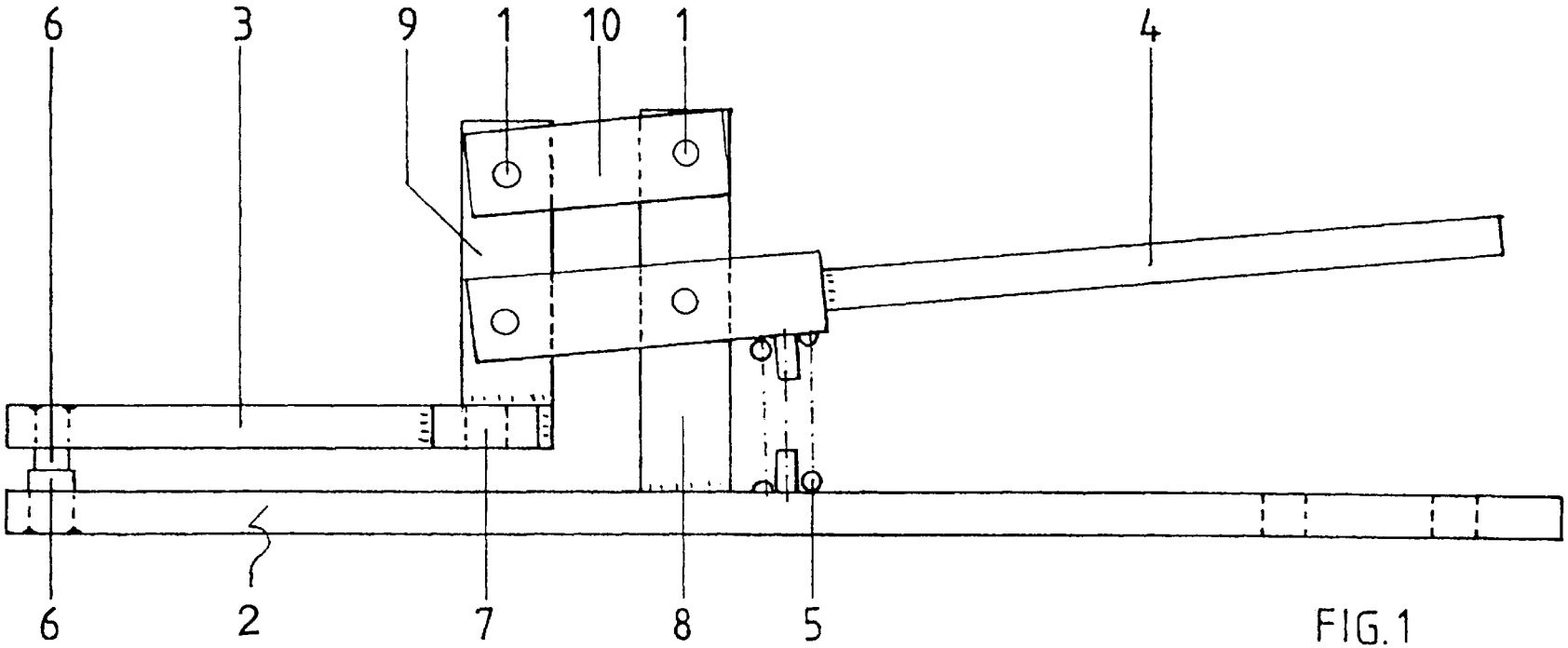
FIG. 1 is a diagrammatic, side-elevational view of a manually operated fastening apparatus according to the invention.

In all the figures of the drawing, sub-features and integral parts that correspond to one another bear the same reference symbol in each case. Referring now to the figures of the drawing in detail and first, particularly, to FIG. 1 thereof, there is shown a fastening apparatus for holding work-pieces in the form of plates for use in electrochemical baths. The fastening apparatus has a base limb 2; 12 and a clamping limb 3; 13 on which struts 8; 18; 9; 19, which extend approximately at right angles from the limbs, are disposed parallel to one another and spaced apart, and are connected to one another via coupling elements 10; 20 and joints 1; 11 that are involved. This parallelogram-like configuration of the multi-jointed connection of the two base and clamping limbs 2; 3; 12; 13 allows a parallel movement to be produced so that, in particular, the contact surfaces remain parallel to one another irrespective of the extent of the opening between the limbs.

A first embodiment, as illustrated in FIG. 1, can be operated manually via an operating lever 4, in which case the lever 4 acts on one of the coupling elements 10 under which a spring 5 also acts on a side facing away from contacts 6, and the spring 5 produces the necessary clamping force.

Figure 2:
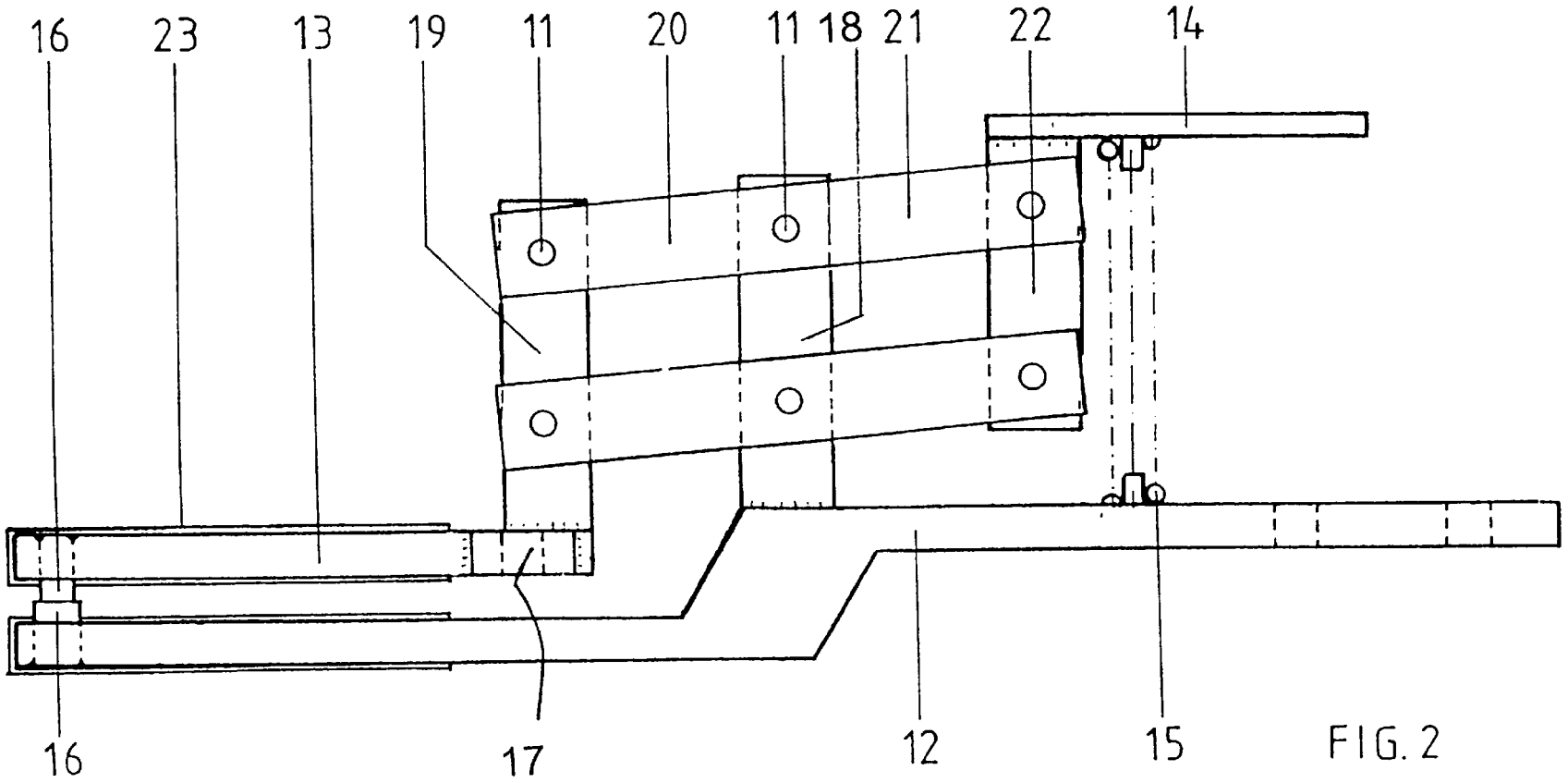
FIG. 2 is a side-elevational view of a second embodiment of the fastening apparatus that can be operated by machine.

The second embodiment of the fastening apparatus, as illustrated in FIG. 2, and which can be operated by a machine, has the coupling elements 20 with lengthening pieces and, on the side opposite contacts 16, is articulated via a coupling piece 22 and the joints 11, connecting them. An operating lever 14 is provided which is aligned parallel to a fastening end of the base limb 12 so that, first, the contacts 16 remain aligned parallel to one another in every opening position of the fastening apparatus, and the operating lever 14 likewise remains aligned parallel to the base limb 12. A compression spring 15 is disposed between the operating lever 14 and the base limb 12 and produces a very large clamping force in the region of the contacts 16, since it is a very long distance away from the crucial joints 11 of the struts 18 of the base limb 12.

At their ends opposite the contacts 6; 16, the base limbs 2; 12 each have fastening recesses for fixing the fastening apparatus on a bus bar. The clamping limbs 3; 13 are provided with connecting lugs 7; 17 for providing an electrical connection to the bus bar, with the electrical connection being produced via power cables having a large cross section. Those regions of the base limbs 2; 12 and of the clamping limbs 3; 13 which are immersed in the electrochemical bath can be provided with an anti-adhesion coating 23.

The entire structure is composed, in particular, of solid stainless steel or copper sheathed in stainless steel or titanium, with the current routing being configured such that none of the joints 1; 11 impairs the current flow of up to 200 A. The contacts 6; 16 are also preferably welded to the limb ends, but they can also be fixed there in any other way, for example being screwed to one another by a mutual thread.

I claim:

1. A fastening apparatus, comprising:

limbs having limb ends;

a multi-jointed connection connecting said limbs to one another;

a spring for compressing said limb ends of said limbs and disposed on at least one of said limbs; and electrical contacts disposed in a region of said limb ends and are aligned inwards with respect to one another and have mutually parallel contact surfaces between which a work-piece can be clamped, said electrical contacts having contact surfaces aligned parallel to one another in every opening position of said limbs.

2. The fastening apparatus according to claim 1, wherein said multi-jointed connection is a four-jointed connection having two coupling elements and two struts which are each disposed on one of said limbs and are each connected in a jointed manner to one another by said two coupling elements; and including an operating lever disposed on one of said two coupling elements.

3. The fastening apparatus according to claim 1, wherein said multi-jointed connection is a six-jointed connection having a common coupling piece, two coupling elements, and two struts which are each disposed on one of said limbs and are each connected in a jointed manner to one another by said two coupling elements, said coupling elements having lengthening projections which are each connected in a jointed manner to one another via said common coupling piece and joints; and including an operating lever disposed on said common coupling piece.

4. The fastening apparatus according to claim 3, wherein said operating lever and one of said limbs being a base limb are configured to be parallel to one another.

5. The fastening apparatus according to claim 4, wherein said spring is disposed between said base limb and said operating lever.

6. The fastening apparatus according to claim 1, wherein said limbs include a clamping limb and a base limb;

wherein said multi-jointed connection includes a joint;

including a contact lug for connecting to an electrical connecting line disposed in front of said joint on said clamping limb at an end opposite said contacts.

7. The fastening apparatus according to claim 1, wherein said limb ends are configured in a form of forks in a region of said contacts.

8. The fastening apparatus according to claim 1, wherein more than one of said electrical contacts is disposed at one of said limb ends, and in that said electrical contacts are disposed offset with respect to one another.

9. The fastening apparatus according to claim 1, wherein said limbs are configured for receiving work-pieces in a form of plates for use in electrochemical baths.

10. The fastening apparatus according to claim 1, wherein said spring is disposed between one of said limbs and one of said coupling elements.

* * * * *